US010215399B2

(12) United States Patent
Costanzo et al.

(10) Patent No.: US 10,215,399 B2
(45) Date of Patent: Feb. 26, 2019

(54) SMALL SUPERCRITICAL ONCE-THRU STEAM GENERATOR

(71) Applicant: Babcock & Wilcox Power Generation Group, Inc., Barberton, OH (US)

(72) Inventors: Michael A Costanzo, Rocky River, OH (US); James S Bloss, Medina, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 398 days.

(21) Appl. No.: 13/826,071

(22) Filed: Mar. 14, 2013

(65) Prior Publication Data

US 2014/0262257 A1 Sep. 18, 2014

(51) Int. Cl.

| | |
|---|---|
| ***F22B 29/06*** | (2006.01) |
| ***F22G 7/12*** | (2006.01) |
| ***F22D 1/02*** | (2006.01) |
| ***F22G 1/02*** | (2006.01) |

(52) U.S. Cl.

CPC ..... *F22G 7/12* (2013.01); *F22B 29/06* (2013.01); *F22D 1/02* (2013.01); *F22G 1/02* (2013.01); *Y10T 29/49387* (2015.01)

(58) Field of Classification Search

CPC ..... F22B 29/06; F22B 1/1815; F22B 1/24; F22B 29/067; F22B 29/061; F22D 1/02; F24D 11/005; F24D 2200/18; F22G 7/14; F22G 5/123

USPC ..... 122/406.4, 421, 468, 477, 1 B, 1 R, 122/193–195, 197, 198; 166/303

See application file for complete search history.

(56) References Cited

U.S. PATENT DOCUMENTS

| | | | | |
|---|---|---|---|---|
| 1,969,405 | A * | 8/1934 | Kerr | F22B 21/34 122/299 |
| 2,295,538 | A * | 9/1942 | Bailey | F22G 1/02 122/477 |
| 3,357,407 | A | 12/1967 | Fanaritis | |
| 3,548,788 | A * | 12/1970 | Altman | F22B 29/067 122/406.4 |
| 3,563,210 | A * | 2/1971 | Hoogendam | F22B 29/06 122/1 B |
| 4,441,550 | A | 4/1984 | Chase | |
| 4,489,679 | A * | 12/1984 | Holt | F22D 1/00 110/186 |
| 5,040,470 | A * | 8/1991 | Lofton | F22B 35/002 110/188 |
| 5,076,357 | A | 12/1991 | Marquis | |
| 6,508,206 | B1 * | 1/2003 | Rechtman | F22B 37/025 122/1 C |

(Continued)

OTHER PUBLICATIONS

Babcock & Wilcox, "Struthers Thermo-Flood Enhanced Oil Recover Systems," Brochure E101-3213, 2011, Babcock & Wilcox Power Generation Group, Inc., Barberton, Ohio, U.S.A., 4 pages.

*Primary Examiner* — Steven B McAllister
*Assistant Examiner* — Ko-Wei Lin
(74) *Attorney, Agent, or Firm* — Michael J. Seymour

(57) ABSTRACT

A small supercritical once-through steam generator (OTSG) includes a radiant section with a furnace coil, and a convection section downstream of the radiant section that includes a superheater which is fluidically connected to the furnace coil. Optionally, the OTSG is devoid of a steam separator. An economizer can also be included downstream of the superheater. Supercritical steam can be generated using the OTSG, for use, among other things, in enhanced oil recovery applications.

21 Claims, 11 Drawing Sheets

(56) References Cited

U.S. PATENT DOCUMENTS

| | | | | |
|---|---|---|---|---|
| 6,536,380 | B1 * | 3/2003 | Kral | F22B 21/346 122/406.3 |
| 6,782,947 | B2 | 8/2004 | deRouffignac et al. | |
| 7,387,090 | B2 * | 6/2008 | Russoniello | F22B 1/02 122/406.1 |
| 7,740,065 | B2 | 6/2010 | Choi | |
| 7,942,203 | B2 | 5/2011 | Vinegar et al. | |
| 8,235,141 | B2 | 8/2012 | Foppe | |
| 9,182,114 | B2 * | 11/2015 | Price | E21B 43/2406 |
| 2006/0042794 | A1 | 3/2006 | Pfefferle | |
| 2006/0065213 | A1 * | 3/2006 | Sarkar | F22B 31/00 122/406.1 |
| 2007/0144457 | A1 * | 6/2007 | Russoniello | F22B 1/02 122/448.3 |
| 2009/0077971 | A1 * | 3/2009 | Schu | F01K 3/183 60/670 |
| 2010/0276124 | A1 * | 11/2010 | Klarner | F22B 29/06 165/134.1 |
| 2011/0017449 | A1 * | 1/2011 | Berruti | E21B 36/025 166/272.3 |
| 2011/0226473 | A1 | 9/2011 | Kaminsky | |
| 2012/0048215 | A1 * | 3/2012 | Hicks | D21F 5/20 122/1 C |
| 2013/0161009 | A1 * | 6/2013 | Price | E21B 43/2406 166/303 |

* cited by examiner

SMALL SUPERCRITICAL ONCE-THRU STEAM GENERATOR

BACKGROUND

The present disclosure relates generally to apparatuses, devices, and associated equipment used to produce supercritical steam. The supercritical steam may be used with advanced methods of enhancing oil recovery, among other processes.

Nearly two-thirds of the world's energy demand is satisfied by oil and natural gas, including the vast majority of transportation fuel in developed countries. However, the demand for energy continues to increase. Concurrently, hydrocarbon (i.e., oil and gas) reservoirs located within the Earth's strata differ in the ease with which their hydrocarbons can be extracted. The reservoirs that are easiest to produce from are more quickly exhausted.

Extraction of hydrocarbons (i.e., oil and gas) occurs in multiple stages. During the primary recovery stage, the natural underground pressure of the hydrocarbon-containing reservoir/formation and/or conventional pumping systems are used to extract low viscosity (i.e., pumpable) hydrocarbons.

Over the lifetime of a given well, the natural pressure of the hydrocarbon-containing reservoir will eventually fall, and the remaining hydrocarbons will be of high enough viscosity that conventional pumping systems will be unable to extract the hydrocarbons. Enhanced oil recovery methods aim to recover the remaining oil and gas from such reservoirs. Enhanced oil recovery refers to hydrocarbon production techniques in which the physical properties of the oil within the reservoir are altered to allow additional oil to be recovered from the underground rock formation.

Steamflooding is one example of an enhanced oil recovery technique. In steamflooding, steam is injected into a hydrocarbon-containing reservoir in order to improve oil displacement and/or fluid flow. The heat energy in the steam is transferred to the reservoir/formation. Heated hydrocarbons in the reservoir become less viscous and also swell/expand. This aids in releasing the hydrocarbons from the reservoir and also eases movement through the formation to the production wells where the hydrocarbons are extracted using conventional pumping technology. The steam may condense as it moves through the reservoir, resulting in waterflooding which also drives hydrocarbons out to the production wells. Light fractions of crude oil may be vaporized and thus provide an additional driving force to aid the flow of oil.

Existing infrastructure (e.g., production wells) can be used or modified for use in steamflooding applications. Use of enhanced oil recovery techniques can prolong the life of an oil field considerably (e.g., from 25 to 30 years), reduce oil exploration costs, and alleviate/lessen political problems and/or environmental concerns.

Current subcritical steamflood boilers typically provide 70 to 80 percent quality steam (i.e., a "wet" two phase steam/liquid water mixture containing 70-80% steam and 30-20% water) at pressures of approximately 2400 psi or less. Typically, a single boiler provides the wet steam to a large piping distribution network that supplies steam to a plurality of steam injectors. The steam injectors may be located a significant distance from the boiler. It can be difficult to split the steam/water mixture from current subcritical steamflood boilers evenly among the various injector wells and nozzles. When there is a flow split in the piping system, it is very difficult to get an even mixture of steam/water in each of the downstream legs to the steam injectors. In a worst case scenario, for example, one downstream leg could receive all vapor (i.e., steam) while a different leg could receive all condensate (i.e., water). This outcome is undesirable because it is important that each steam injection well receives a minimum "latent heat" for maximum recovery efficiency.

Steam separators may be utilized with subcritical steamflood boilers to provide a higher quality of steam to a reservoir. However, this increases equipment costs and leads to the liquid water portion of the steam/water mixture not being delivered, which significantly reduces overall system efficiency.

It is therefore desirable to develop new, efficient, and economical apparatuses, systems, and methods that can be used in enhanced oil recovery or to generate dry supercritical steam for various applications.

BRIEF DESCRIPTION

The present disclosure relates, in various embodiments, to apparatuses and methods for generating supercritical steam (single phase dry steam). Generally, the supercritical once thru steam generators (OTSGs) disclosed herein include a furnace/radiant section, a convection section, and a furnace coil in the radiant section connected to an economizer and optionally a superheater in the convection section. In preferred embodiments, the supercritical OTSG is devoid of a steam separator to produce single phase dry steam.

Disclosed in embodiments is an apparatus for producing supercritical steam for use, for example, for injection into an underground hydrocarbon-containing reservoir. The apparatus includes at least one furnace coil in a radiant section for generating steam above the critical point; and a superheater that is in fluid communication with the at least one furnace coil and is located in a convection section of the boiler downstream of the radiant section for generating supercritical superheated steam.

In some embodiments, the apparatus further includes an economizer located in the convection section downstream of the superheater. A preheater may be included upstream of the economizer. The apparatus may be devoid of a steam separator.

Disclosed in other embodiments is a supercritical once-through steam generator (OTSG). The OTSG includes a radiant section comprising at least one furnace coil; and a convection section downstream of the radiant section. The convection section includes a superheater in fluid communication with the at least one furnace coil. The OTSG may be devoid of a steam separator.

In further embodiments, the OTSG further includes an economizer located in the convection section downstream of the superheater. The economizer is in fluid communication with the at least one furnace coil.

The OTSG may further include a feedwater preheater upstream of the economizer. In some embodiments, the feedwater preheater is a dual pass heat exchanger comprising a first pass inlet for receiving feedwater, a first pass outlet in fluid communication with an inlet of the economizer, a second pass inlet in fluid communication with an outlet of the economizer, and a second pass outlet in fluid communication with the at least one furnace coil.

The OTSG may further include a feedwater purifier upstream of the economizer.

In other embodiments, the radiant section includes a horizontally oriented cylindrical housing. The at least one furnace coil may run in a serpentine path from a burner end of the radiant section to an exhaust end of the radiant section along an internal circumference of the cylindrical housing.

The fluid in the superheater may flow in parallel with flue gas traveling through the boiler.

In further embodiments, the at least one furnace coil is smooth bored or is ribbed.

The radiant section may include a total of two furnace coils. In some embodiments, fluid flow from the two furnace coils are combined prior to being split at the superheater.

Fluid flow through the superheater may be split into a first superheater coil and a second superheater coil.

Disclosed in further additional embodiments is a method of enhancing recovery from an underground hydrocarbon-containing reservoir. The method includes generating supercritical steam in a supercritical OTSG; and injecting the supercritical steam into the reservoir to recover hydrocarbons. The supercritical OTSG includes a radiant section comprising at least one furnace coil; and a convection section downstream of the radiant section. The convection section includes a superheater in fluid communication with the at least one furnace coil. The OTSG may be devoid of a steam separator.

In still other embodiments, the supercritical steam is injected into the reservoir through a plurality of injection wells. The hydrocarbons may be recovered through one or more production wells.

Also disclosed in embodiments is a method for retrofitting a steamflood boiler for supercritical steam injection. The method includes adding a superheater to the steamflood boiler.

In still further embodiments, the adding the superheater to the steamflood boiler includes lifting an economizer module of the steamflood boiler; and inserting the superheater beneath the lifted economizer module. The method may further include replacing an existing pressure part of an economizer module with a replacement part. The replacement part has a greater thickness and/or is made of a composition having a greater melting point than the existing pressure part.

In other embodiments, the method further includes replacing an existing furnace coil of a combustion chamber module with a replacement part. The replacement part has a greater thickness and/or is made of a composition having a greater melting point than the existing pressure part. The boiler may be devoid of a steam separator.

These and other non-limiting aspects and/or objects of the disclosure are more particularly described below.

BRIEF DESCRIPTION OF THE DRAWINGS

The following is a brief description of the drawings, which are presented for the purposes of illustrating the exemplary embodiments disclosed herein and not for the purposes of limiting the same. Some components that may be common to subcritical boilers of this type may have been removed for clarity.

DETAILED DESCRIPTION

Figure 1:
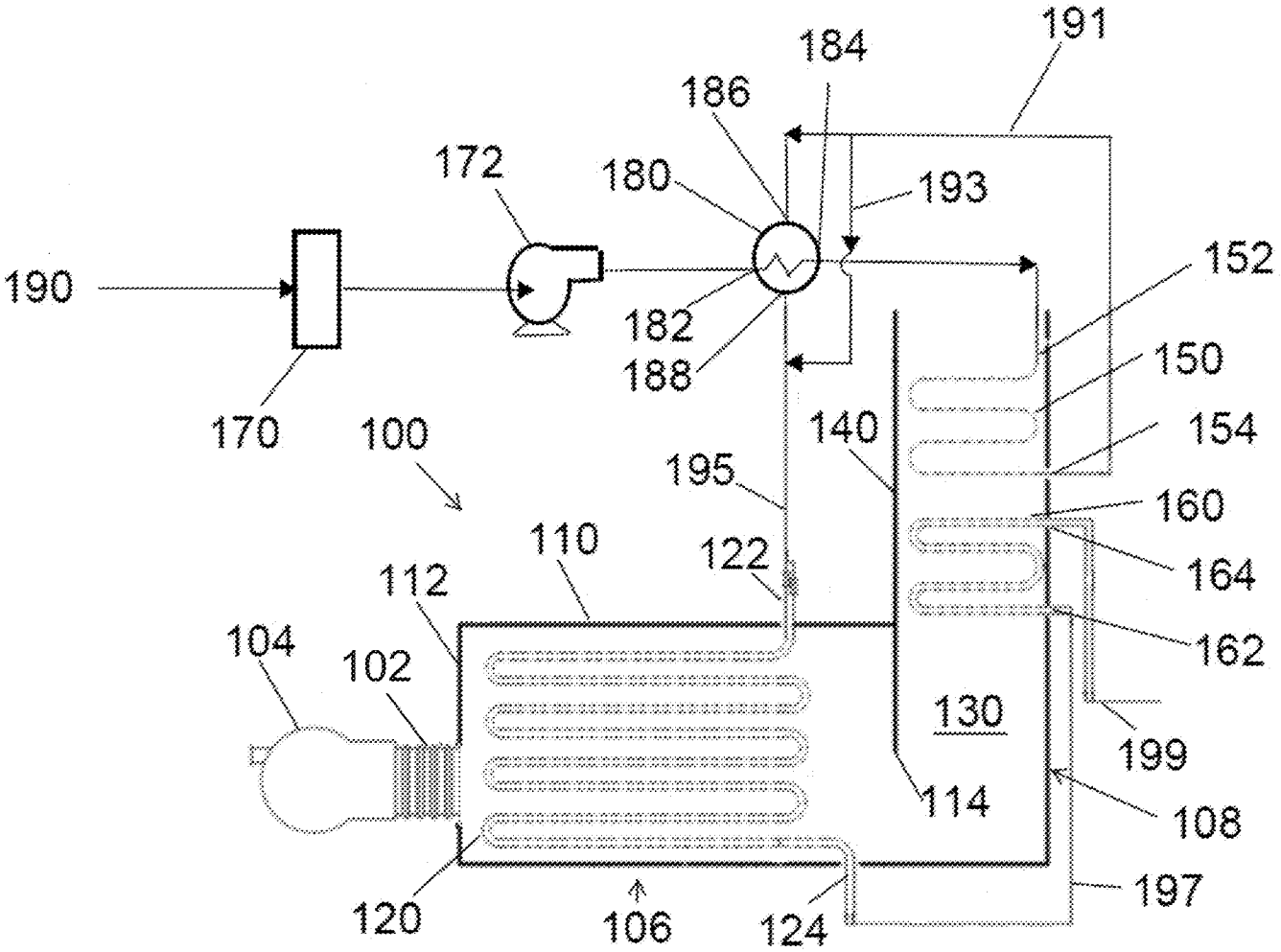
FIG. 1 is a schematic diagram of a supercritical OTSG of the present disclosure.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

It should be noted that many of the terms used herein are relative terms. For example, the terms "interior" and "exterior", or "central" and "end", are relative to a center, and should not be construed as requiring a particular orientation or location of the structure. Similarly, the terms "upper" and "lower" are relative to each other in orientation, i.e., an upper component is located at a higher elevation than a lower component in a given orientation, though the orientation can be changed (e.g., by flipping the components 180 degrees). The terms "inlet" and "outlet" are relative to a fluid flowing through them with respect to a given structure, e.g., a fluid flows through the inlet into the structure and flows through the outlet out of the structure. The terms "upstream" and "downstream" are relative to the direction in which a fluid flows through various components, i.e., the flow fluids through an upstream component prior to flowing through the downstream component.

The terms "horizontal" and "vertical" are used to indicate direction relative to an absolute reference, i.e., ground level. However, these terms should not be construed to require structures to be absolutely parallel or absolutely perpendicular to each other. For example, a first vertical structure and a second vertical structure are not necessarily parallel to each other. The terms "top" and "bottom" are used to refer to surfaces where the top is always higher than the bottom relative to an absolute reference.

To the extent that explanations of certain terminology or principles of the heat exchanger, boiler, and/or steam generator arts may be necessary to understand the present disclosure, the reader is referred to *Steam/its generation and use,* 40$^{th}$ Edition, Stultz and Kitto, Eds., Copyright© 1992, The Babcock & Wilcox Company, and *Steam/its generation and use,* 41$^{st}$ Edition, Kitto and Stultz, Eds., Copyright© 2005, The Babcock & Wilcox Company, the texts of which are hereby incorporated by reference as though fully set forth herein.

As used herein, the term "supercritical" refers to a fluid that is at a pressure above its critical pressure or approximately 3200 psia (22.1 MPa) for water. The supercritical fluid always exists as a single phase regardless of temperature. At temperatures below the critical point, the supercritical fluid is described as having water-like properties. At temperatures above the critical point, the supercritical fluid is described as having steam-like properties A fluid at a temperature that is above its boiling point at a given pressure but is below its critical pressure is considered to be "superheated" but "subcritical". A subcritical superheated fluid can be cooled (i.e., transfer energy) without changing its phase until it cools sufficiently to reach its condensation temperature.

As used herein, the term "quality" refers to the mass fraction of a subcritical fluid that is vapor (i.e., gas phase). For example, steam having a quality of 80 percent is a saturated steam mixture that has 80 weight percent steam and 20 weight percent liquid water.

As used herein, the term "wet steam" refers to a subcritical saturated steam/water mixture (i.e., steam with less than 100% quality).

As used herein, the term "dry steam" refers to steam having a quality of 100% (i.e., no liquid water is present).

The present disclosure relates to supercritical OTSGs which may include a superheater but do not include a steam separator (e.g., a steam drum, a vertical steam separator, chevrons, or other steam separating devices). These supercritical OTSGs may be used in enhanced oil recovery applications, particular for applications wherein the oil is too viscous for extraction via conventional pumping technologies and/or located at a great depth where the natural reserve pressure is in excess of the capabilities of subcritical boilers.

Current steamflood boilers used in enhanced oil recovery (EOR) applications produce subcritical steam (e.g., steam at pressures up to approximately 2400 psig), typically having a steam quality of about 70% to 80%. Such boilers may also be referred to as subcritical pressure once-through steam generators (subcritical pressure OTSGs). Larger top supported boilers that operate at supercritical pressures are commonly used to generate steam for electricity production. However, the turbines used to generate electricity cannot receive water or a steam/water mixture, as occurs during startup/initial firing of the boiler. Thus, a steam separator is present in larger supercritical boilers to remove any liquid water from the steam during the period before high enough temperatures are developed to insure a 100% dry steam product is available to the steam turbine.

Supercritical steam possesses some beneficial properties relative to subcritical steam in steamflood enhanced oil recovery applications. At 80% boiler outlet steam quality (i.e., subcritical), the outlet enthalpy decreases as pressure is increased above about 1000 psig. Thus, if the pressure is increased in a conventional once-through steam generator, the available thermal energy in the outlet steam actually decreases. In the supercritical boilers of the present disclosure, the outlet steam will always be dry and the outlet enthalpy can be increased to meet any desired outlet condition without the use of a steam separator. Distribution problems related to two phase steam produced by traditional subcritical pressure steamflood boilers are eliminated. The increased outlet enthalpy may permit also the use of less steam for a given thermal load, thereby reducing the infrastructure size and cost. The boilers and methods of the present disclosure may also enhance the efficiency of recovering difficult-to-recover oil and natural gas (e.g., oil from great depths and/or highly viscous oil).

Under supercritical conditions, the water will remain a single phase fluid as it is heated converting from liquid to steam without creating bubbles thereby eliminating problems associated with maintaining a homogenous mixture of a multi phase fluid within a distributed piping system.

Some enhanced oil recovery applications may advantageously use supercritical pressure steam in a smaller capacity steam generator. For example, heavy oil reserves at depths resulting in pressures in excess of the critical pressure of steam cannot be exploited using subcritical steam. This smaller supercritical OTSG is portable and modular. In some embodiments, the smaller supercritical steamflood boilers of the present disclosure are configured such that they can be transported as an integral working unit by truck or train.

FIG. 1 is a schematic diagram of a supercritical OTSG 100 of the present disclosure. The boiler 100 includes a horizontally oriented cylindrical housing 110 and a vertical housing 140. Although the presented embodiment illustrates the orientation of the component parts as horizontal and vertical, the orientation may be changed in other embodiments. The cylindrical housing has a burner end 112 and an exhaust end 114. In alternate embodiments, the housing could have square or rectangular-shaped cross-sections rather than being cylindrical. A burner 102 is located at the burner end, which is opposite the exhaust end and opposite the vertical housing. A combustion air blower 104 provides air to the burner. In some embodiments, multiple burners may be present. The cylindrical housing 110 acts as the radiant section 106 of the supercritical boiler. A furnace coil 120 is located within the cylindrical housing 110 and runs in a serpentine path between the burner end 112 and the exhaust end 114. The furnace coil tubing could be arranged as spiral or as multi flow path panels as an alternate to the serpentine coils depending on the housing configuration. The furnace coil 120 has an inlet 122 and an outlet 124.

At the exhaust end 114 of the cylindrical housing is a convection flue 130 that joins the cylindrical housing 110 to the vertical housing 140. Depicted here as being located within the vertical housing 140 are a superheater 160 and an economizer 150. The superheater 160 is physically located between the furnace coil 120 and the economizer 150. Put another way, relative to the flue gas flow path, the superheater 160 is downstream of the furnace coil 120, and the economizer 150 is downstream of the superheater 160. The economizer 150 has an inlet 152 and an outlet 154. The superheater 160 also has an inlet 162 and an outlet 164.

The supercritical steamflood boiler includes a gas flow path and a water/steam flow path. The gas flow path begins at the burner end 112, where fuel from a source (not shown, but advantageously a liquid or gaseous fuel) and air are mixed and combusted by burner 102. The resulting hot flue gas travels horizontally through the radiant section 106 of the cylindrical housing and into the convection flue 130, where the flue gas changes direction to travel vertically through the vertical housing 140. As the hot flue gas travels, it passes, in sequence, the furnace coil 120, the superheater 160, and the economizer 150, transferring heat energy to the water/steam in these tubes. The flue gas then exits through a stack (not shown). If desired, the flue gas can be recirculated back to the burner, though this is not illustrated.

The water/steam flow path begins with feedwater 190. The feedwater must be of sufficient purity to be useful in the supercritical steamflood boiler. As the fluid temperature increases, impurities will precipitate out and deposit upon the interior of the tubing of the supercritical steamflood boiler. Accumulated deposits can impede heat transfer, causing loss of boiler efficiency and overheating tube failures. They can also be corrosive to the tubing. To reduce/prevent these problems, the feedwater should be of purity sufficient to limit the frequency of tube cleaning. A feedwater purifier is schematically illustrated here with reference numeral 170.

The feedwater must be provided at a pressure of at least about 3,250 psig to maintain supercritical characteristics. In some embodiments, the feedwater is provided at a pressure of from about 3,250 psig to about 4,350 psig, preferably from about 3,250 to about 4,000 psig. Higher feedwater pressures are possible if required by the downstream process system requirements. A feedwater pump 172 is illustrated here to provide the feedwater with the requisite pressure. It should be noted that the order of the feedwater purifier 170 and the feedwater pump 172 can be switched as desired.

The feedwater should be provided to the economizer 150 at a temperature of from about 60° F. to about 240° F., preferably from about 140° F. to about 175° F. This minimizes the potential for tube/fin corrosion. It keeps the flue gas exiting the unit above the dew point of the products of combustion from the fuel being fired. The constituents within the fired fuel will determine acid dew point. As a result, the condensation of flue gases can be minimized, reducing corrosion and increasing economizer lifetime. Desirably, the flue gas exiting the supercritical steamflood boiler has a temperature of from about 200° F. to about 300° F., possibly lower if corrosive species are not present in the products of combustion. In some embodiments, the feedwater temperature is controlled using a feedwater preheater 180 located upstream of the economizer 150 (relative to the fluid flow, not the gas flow).

Here, the feedwater preheater is depicted as a dual pass heat exchanger. The heat exchanger contains two flow paths, a first pass and a second pass. The first pass flows from a first pass inlet 182 to a first pass outlet 184. The second pass flows from a second pass inlet 186 to a second pass outlet 188. Exemplary heat exchangers include a tube-and-shell design, though other configurations may be desirable depending on space limitations.

The feedwater 190 enters the first pass inlet 182, is heated, and exits at the first pass outlet 184, where the heated feedwater then enters the economizer inlet 152. There, the feedwater within the economizer is heated by the flue gas to a temperature of about 450° F. to about 550° F. This water then exits at the economizer outlet 154. The water in the economizer flows counter-current to the flue gas flow.

Upon exiting the economizer, the heated water is split into two paths. In one flow path 191, the heated water enters the second pass inlet 186 of the dual pass heat exchanger, where the heat is transferred to the feedwater, and exits through the second pass outlet 188 at a cooler temperature. The other flow path 193 simply bypasses the heat exchanger. The two flow paths are then recombined (reference numeral 195) and flow to the furnace coil inlet 122. The water entering the furnace coil has a temperature of about 400° F. to about 450° F.

The furnace coil 120 is located about the internal perimeter of the cylindrical housing 110. In this radiant section 106, the furnace coil receives heat by direct radiant absorption from the combustion envelope of the flame. The highest rates of heat transfer and maximum tube wall temperatures are generally experienced in this radiant section. The furnace coil 120 runs in a serpentine path from the burner end 112 to the exhaust end 114. In particular embodiments, the fluid flow from the economizer is split into two separate furnace coils, each coil occupying a portion of the furnace housing. Multiple flow path coil(s) may be present depending on the size/capacity of the steam generator and acceptable steam generator pressure drop. The water will pass through the critical temperature of water in the furnace coils. The flow from the furnace coils is then combined again upon exiting at the furnace coil outlet 124. The temperature of the water exiting the furnace coil is from about 700° F. to about 750° F.

The furnace coil outlet 124 is fluidically connected to the superheater inlet 162 via tubing 197. The superheater superheats the steam to the desired maximum outlet temperature for the process. The superheater 160 is located in the vertical housing 140 adjacent the convection flue 130. The superheater is illustrated here as including four rows of superheater surface exposed to the flue gas exiting the radiant portion of the boiler. In some embodiments, the steam flow through the superheater is parallel with the flue gas traveling through the vertical housing of the boiler. This arrangement reduces overall metal temperatures, with the coolest superheater tubes located in the hottest flue gas. This parallel flow is illustrated here by the superheater inlet 162 being closer to the convection flue 130 than the superheater outlet 164 (i.e., the superheater inlet is upstream of the superheater outlet relative to the gas flow). The quantity of tube rows, the component arrangement, and the parallel/counter flow design is set based on the specific outlet design conditions set by the process steam requirement.

The superheater may be a split flow design to reduce total pressure drop. Similar to the furnace coil, the fluid flow is split into parallel flow paths which are combined at the superheater outlet. Multiple flow path(s) may be present depending on the size/capacity of the steam generator and acceptable steam generator pressure drop. As a further design enhancement, a crossover of the superheater coils within the enclosure can be provided to reduce the potential for steam temperature imbalances at the superheater outlet. The superheater may be eliminated entirely depending upon the outlet steam temperature required by the process.

The final result after exiting the superheater outlet 164 is supercritical superheated steam for process use 199. The outlet steam may have a temperature of from about 710° F. to about 1,000° F. In some embodiments, the outlet steam has a temperature of from about 720° F. to about 900° F., preferably from about 775° F. to about 850° F. The outlet steam may have a pressure of at least approximately 3,200 psig. In some embodiments, the outlet steam has a pressure from about 3,250 to about 4,000 psig, preferably from about 3,250 to about 3,650 psig. This outlet process steam is at approximately 1200 Btu/lb or greater enthalpy to remain single phase dry steam product at any downstream pressure. Such high energy dry steam can improve the distribution of energy within piping systems and between steam injectors to provide uniform heat distribution within a reservoir for maximum oil recovery efficiency.

Although not shown, spray attemperation may be used to control the final temperature of the dry steam. In attemperation, the superheated steam is mixed with a cooler medium (e.g., water or saturated steam) to reduce the temperature of the superheated steam.

The economizer, furnace coil, and superheater operate as heat transfer surfaces to transfer energy from the heated flue gas into the water to generate supercritical steam. These three components are generally made of arrangements of serpentine tubes. The tubes may be smooth on their exteriors or may include fins (e.g., stud fins, longitudinal fins, helical fins, and rectangular fins) that increase the heat transfer surface area and increase the efficiency of heat transfer. In particular embodiments, the furnace coil is smooth bore tubing, the superheater is smooth bore tubing, and the economizer is helical finned tubing. The tubes may also incorporate ribbing or rifling on the interior surfaces if desired for improved heat transfer characteristics.

FIGS. 2-7 are various views of a first exemplary embodiment of a supercritical OTSG. These views include valves, piping, supports, and other pieces which are removed in the different figures to provide better views of the components of the boiler. The views do not include the dual pass heat exchanger.

Figure 2:
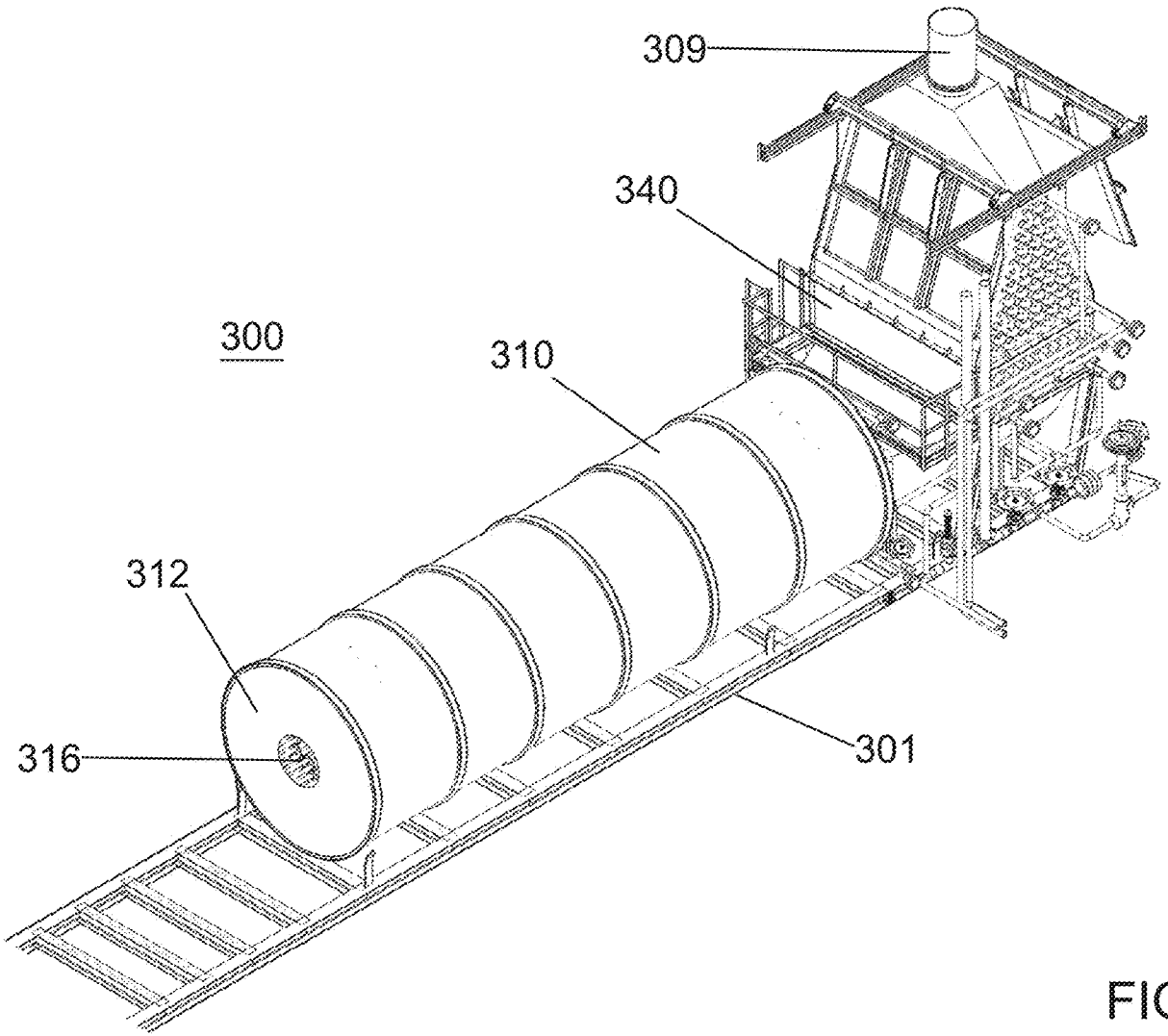
FIG. 2 is an exterior perspective view of an exemplary embodiment of a supercritical steamflood boiler of the present disclosure.

FIG. 2 is a perspective view of the boiler, showing the exterior. The boiler 300 is bottom-supported by a skid 301. The air blower and burner are not included. The burner end 312 of the cylindrical housing 310 is visible, with a central inlet port 316 for the combustion air/flue gas visible. The burner end can be considered the "front" of the boiler. Also visible is the vertical housing 340 and the stack 309 from which the flue gas exits the boiler.

Figure 3:
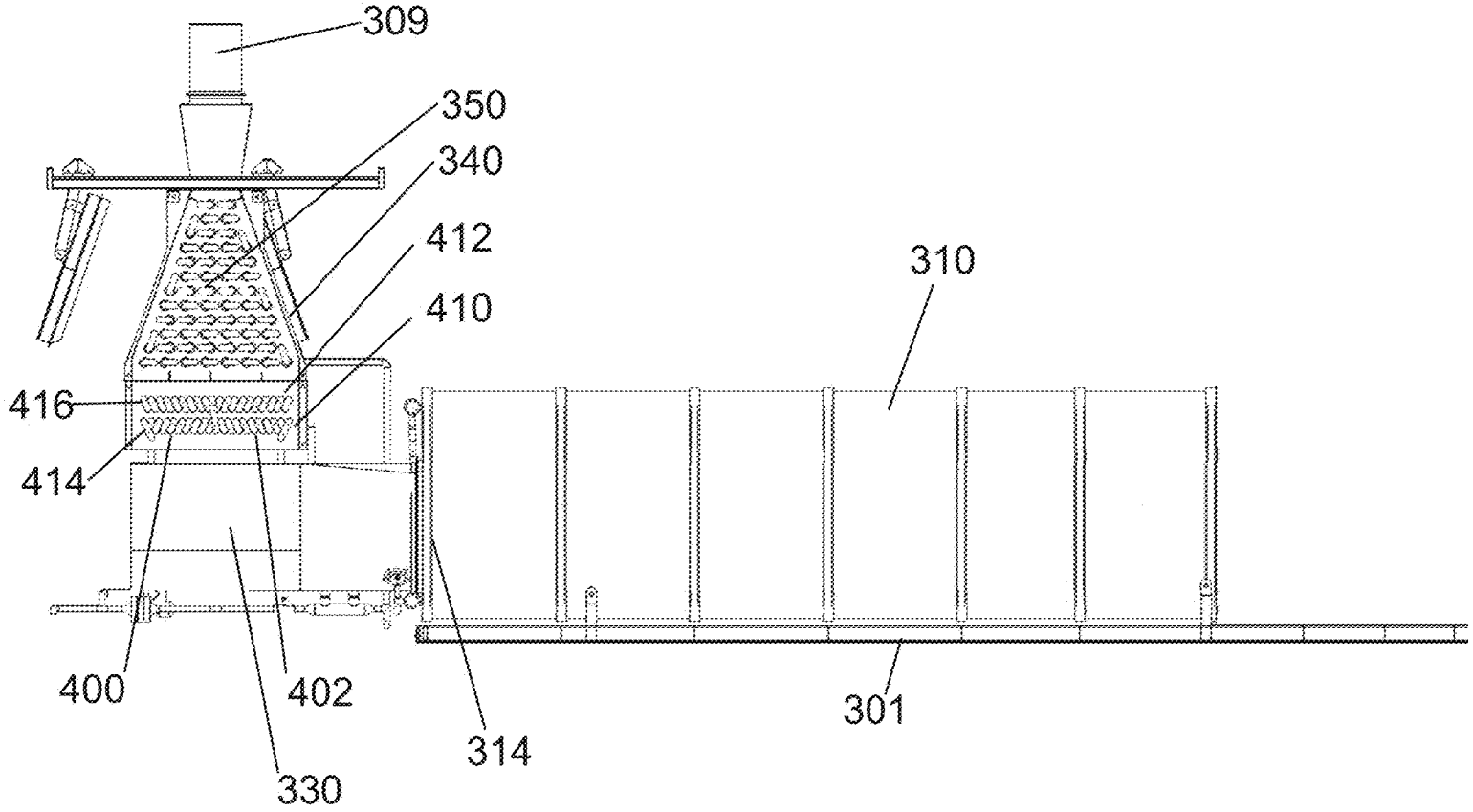
FIG. 3 is a left exterior view of the boiler of FIG. 2, with some components removed for convenience.

FIG. 3 is a left side exterior view of the boiler, with some supports removed for better viewing of other components. The skid 301 and the cylindrical housing 310 are shown. The convection flue 330 is visible at the exhaust end 314 of the cylindrical housing. The vertical housing 340 is located above the convection flue 330. The superheater and the economizer 350 are visible.

As previously mentioned, the superheater may include a parallel flow paths shown as a first superheater coil 400 and a second superheater coil 402, with a crossover to reduce steam temperature imbalances. This aspect is visible in FIG. 3. The superheater here can be divided into four quadrants: a lower front quadrant 410, an upper front quadrant 412, a lower rear quadrant 414, and an upper rear quadrant 416. The first parallel path superheater coil 400 is in the lower front quadrant 410 and the upper rear quadrant 416. The second parallel path superheater coil 402 is in the lower rear quadrant 414 and the upper front quadrant 412. The output from the two superheater coils/flow paths is then combined. The number of flow paths/coils of superheater used depends on the capacity of the boiler, the amount of superheat desired, and limitations in acceptable pressure drop and metal temperatures.

The economizer 350 is tapered, with a greater surface area adjacent the superheater 400, 402 than at its top where the flue gas exits through the stack 309. This tapered shape maintains the velocity of the flue gas for more effective heat transfer as the gases cool as they progress to the stack. The economizer housing could also be straight (without taper) if required by process design parameters.

Figure 4:
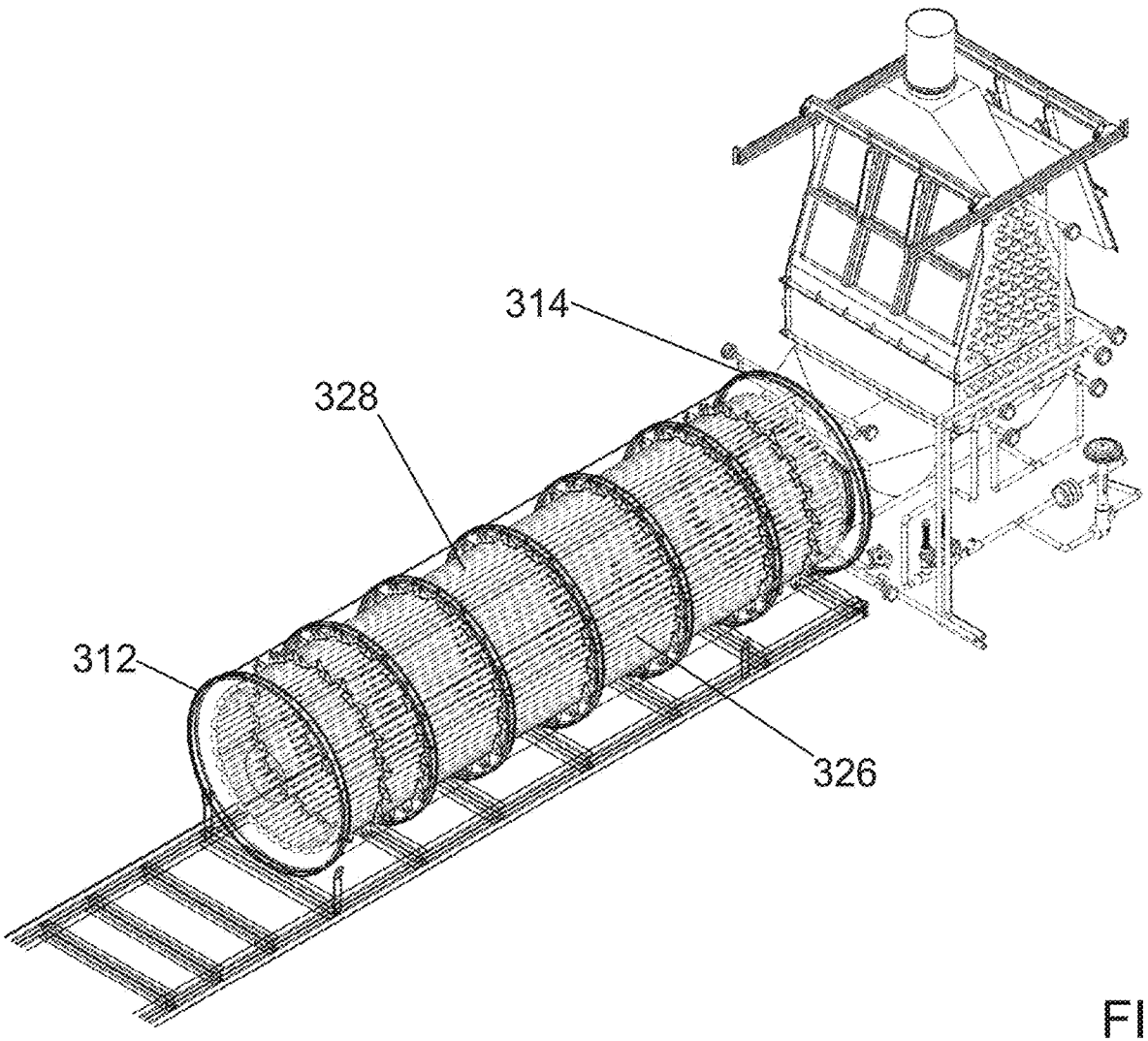
FIG. 4 is a perspective view of the boiler of FIG. 2, with the cylindrical housing made transparent to reveal internal components.
Figure 5:
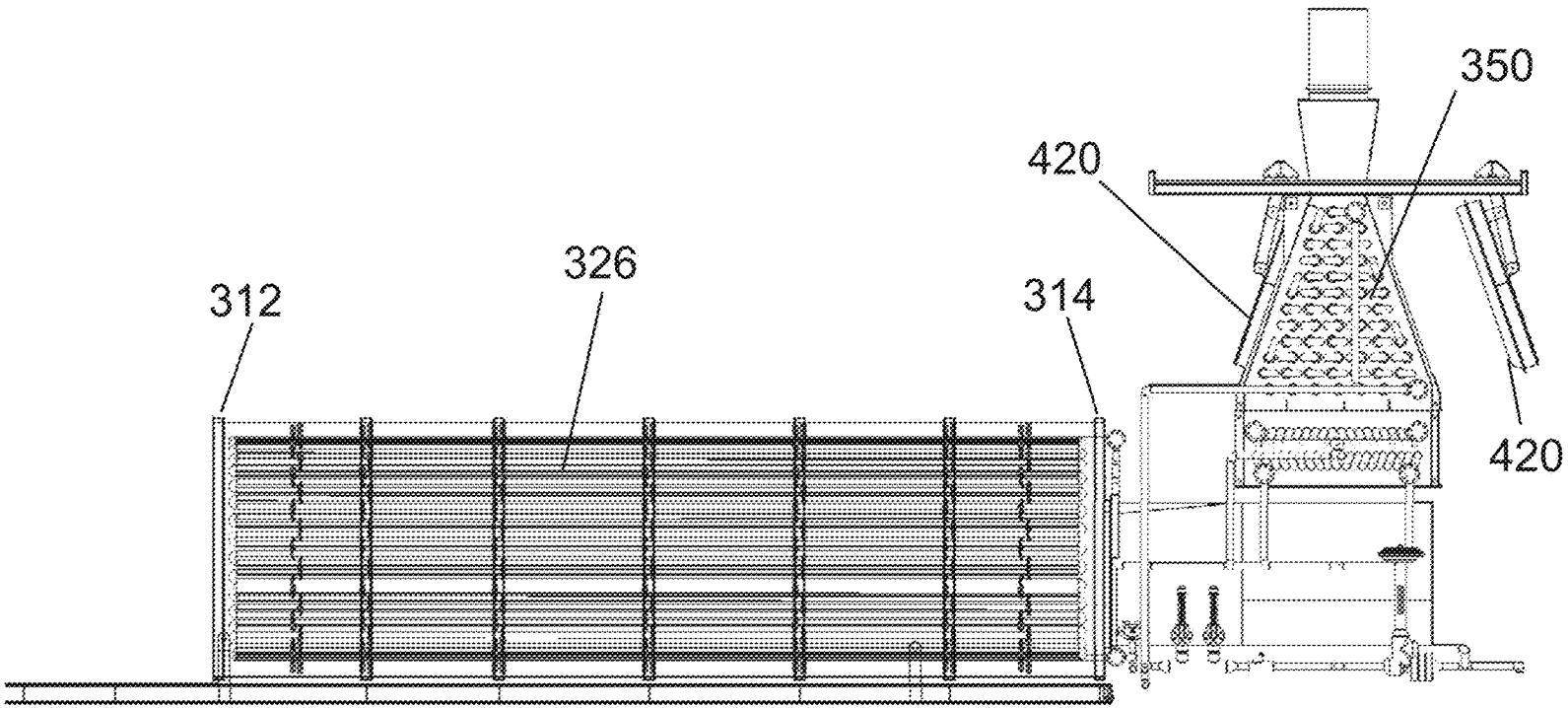
FIG. 5 is a right side view of the boiler of FIG. 4.

FIG. 4 is a perspective view of the boiler, with some supports removed and the cylindrical housing transparent. FIG. 5 is a right side view, again with the cylindrical housing transparent. As illustrated in these two views, there are two furnace coils 326, 328, each taking up a semi-cylindrical portion of the cylindrical housing. Each furnace coil runs in a serpentine path from the burner end 312 to the exhaust end 314 of the cylindrical housing. Put another way, each furnace coil passes multiple times through a radial cross-sectional plane of the cylindrical housing. The number of parallel flow paths and coils of furnace tubes used depends on the capacity of the boiler, the amount of superheat desired and limitations in acceptable pressure drop and metal temperatures.

Each furnace coil is located along an internal perimeter of the cylindrical housing, along the wall. The main flow axis of each furnace coil is parallel to the longitudinal axis of the cylindrical housing. Alternatives may include spiral wound coil configurations.

In FIG. 5, doors 420 can be seen that make up the vertical housing surrounding the economizer 350. These doors are mounted on a trolley system 422 that also provides access to the tubes inside the vertical housing.

Figure 6:
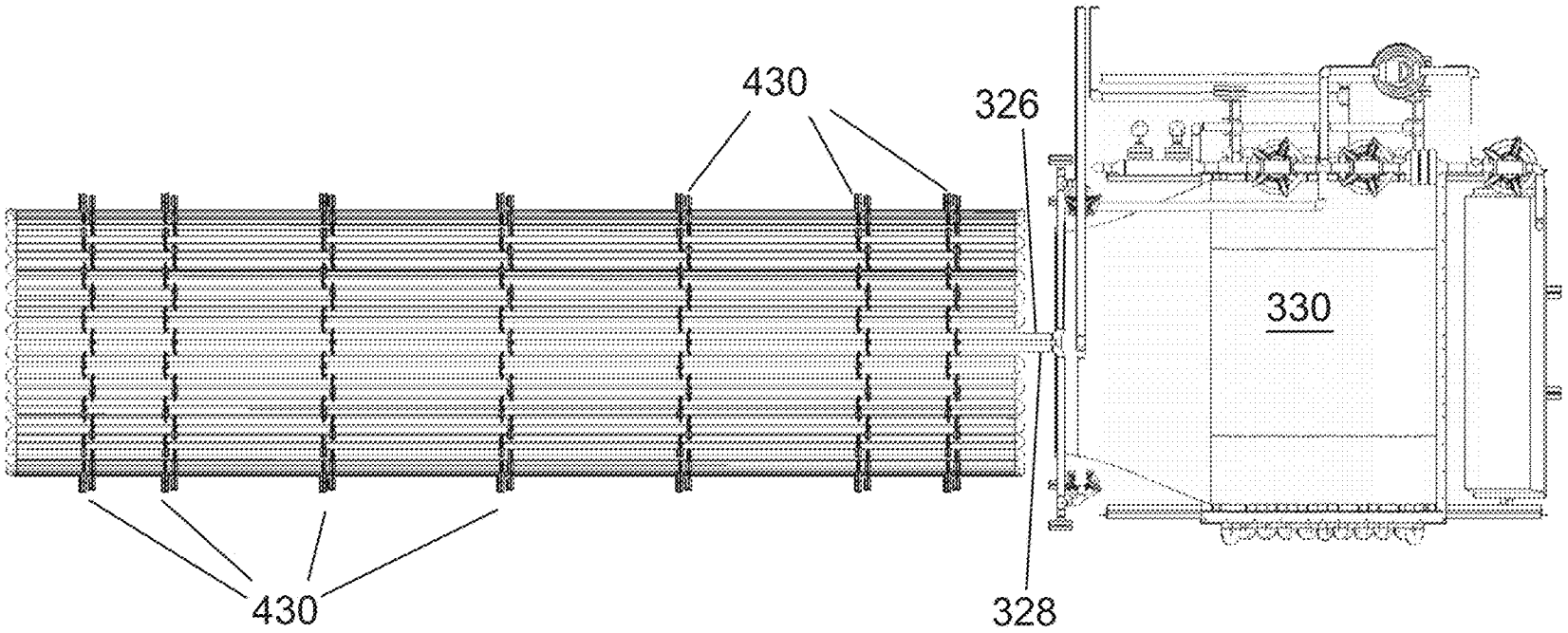
FIG. 6 is a bottom view of the boiler of FIG. 2, with the skid removed to show various components.

FIG. 6 is a bottom view of the boiler, with the skid 301 and the cylindrical housing 310 removed. Here, the inlets for the two furnace coils are visible, as is the convection flue 330. The furnace coils 326, 328 are supported by tube hangers 430 spaced along the length of the cylindrical housing.

Figure 7:
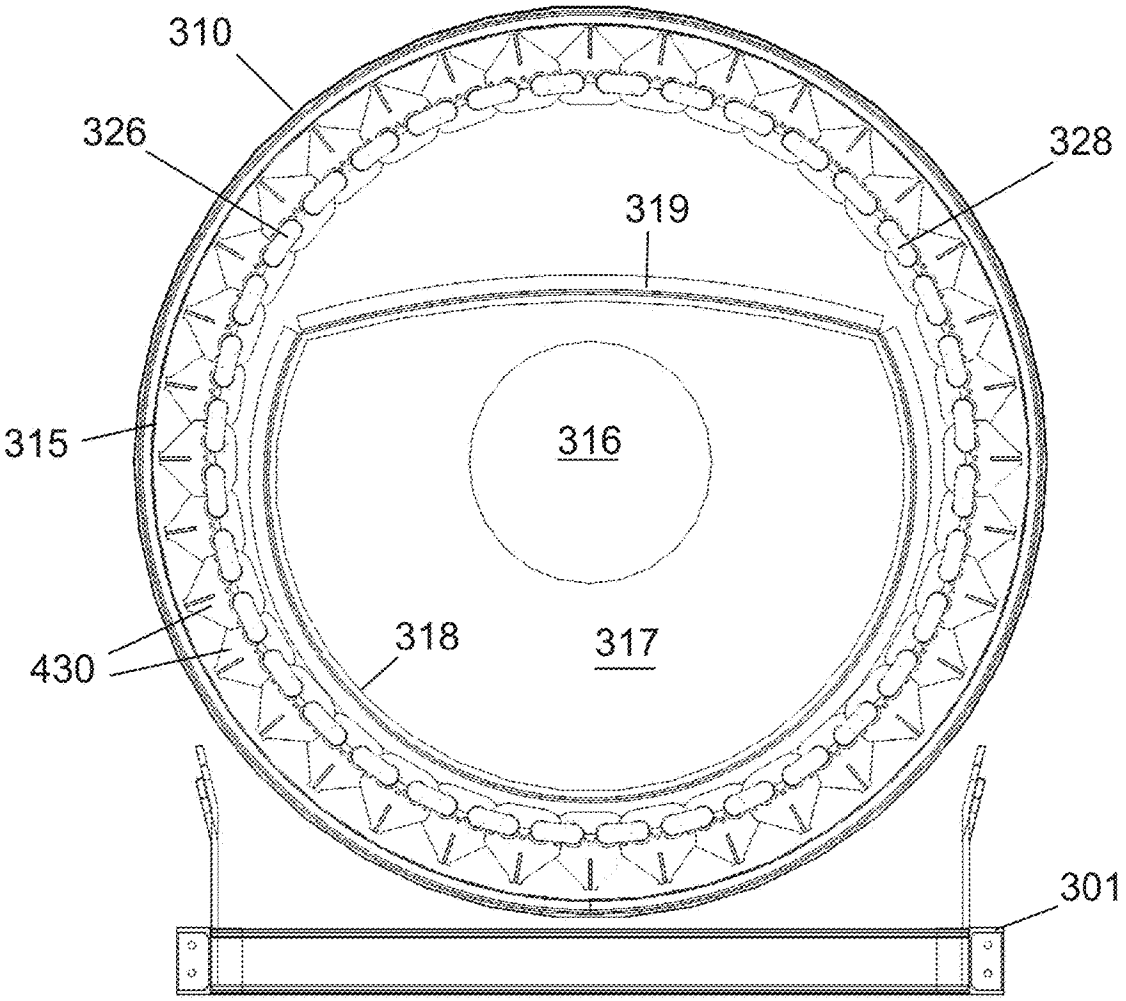
FIG. 7 is a radial cross-sectional view of the cylindrical housing of the boiler of FIG. 2, seen from the rear.

FIG. 7 is a cross-sectional view of the cylindrical housing 310, viewed from the rear. The skid 301 is visible along the bottom of the housing. Located at the exhaust end is an outlet port 317 that connects to the convection duct. The outlet port has a perimeter formed by an arc 318 and a chord 319. The central inlet port 316 at the burner end is visible through the outlet port. The ends of the furnace coils 326, 328 are seen along the internal perimeter 315 of the cylindrical housing. The furnace coils are supported by the tube hangers 430, which are also spaced evenly around the circumference of the housing.

Figure 8:
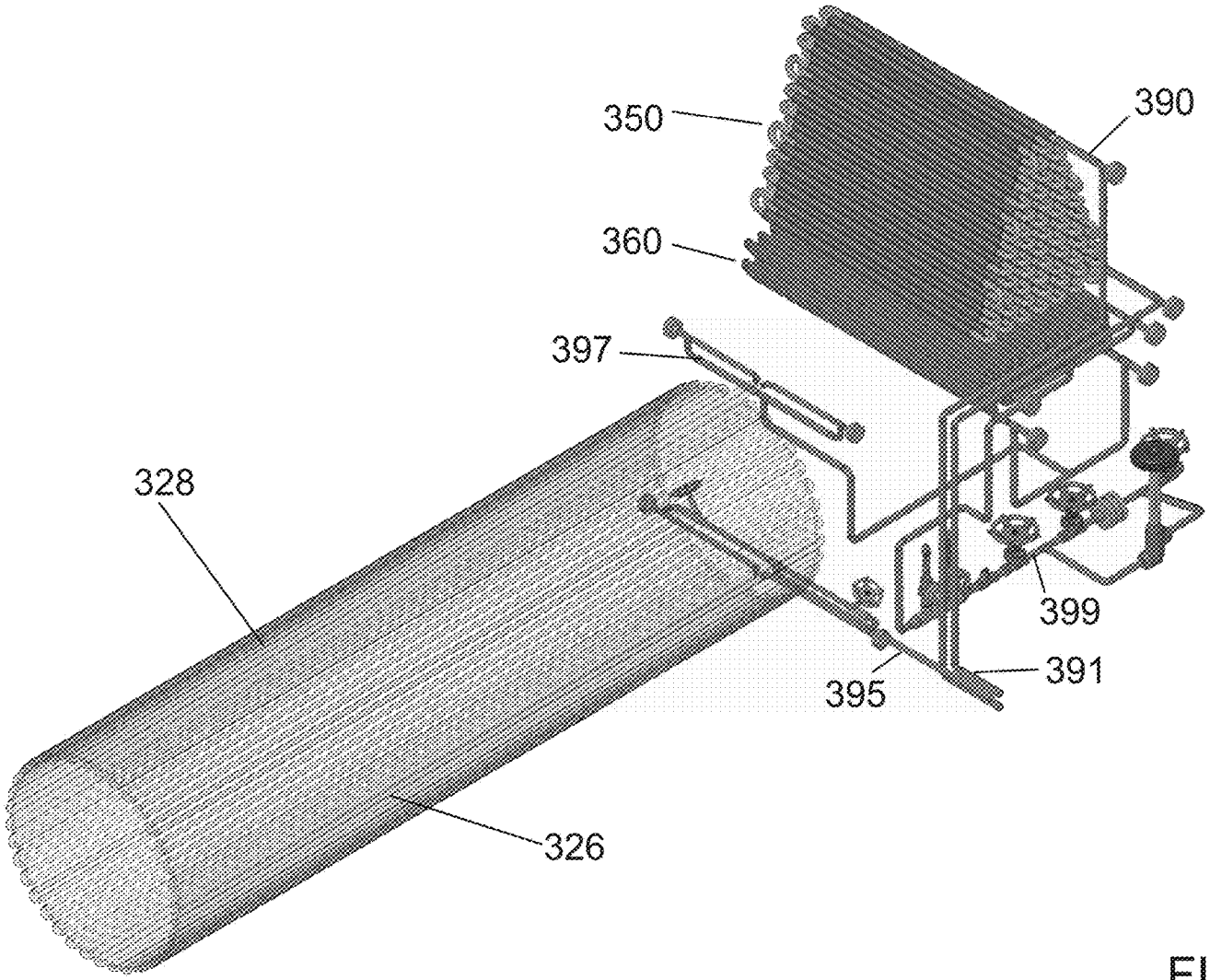
FIG. 8 is a perspective view of the fluid tubing of the boiler of FIG. 2.

FIG. 8 is a perspective view showing only the tubing through which the water/steam flows. The heat exchanger is not shown here, though it would be located on the left side and piping is shown leading to it. Cold supercritical feedwater 390 enters at the top of the vertical housing into the economizer 350 and is heated, then goes to the heat exchanger (pipe 391). Heated supercritical water 395 enters the furnace coils 326, 328 at the bottom of the cylindrical housing and exits at the top of the cylindrical housing 397. Supercritical steam that is above the critical point is then sent to the superheater 360, which flows upwards and then exits to the final process outlet steam 399.

The various components of the supercritical steamflood boiler may be made using processes and materials known in the art. For example, the various tubing and piping may be made from alloys such as SA213T22 (2¼ Cr-1 Mo) or SA335P22 (2¼ Cr-1Mo) steel, or SA106C carbon steel. The tubing can have an inner diameter of approximately 1.5 inches to 5 inches. The support structure (skid, etc.) can be made from carbon steel.

The tubing of the supercritical steamflood boiler can be designed with flanged connections or caps to permit the use of a PIG for cleaning. As seen in the figures described above, the tube bends of the furnace coils, superheater, and economizer are all visible along the exterior of the boiler. A PIG is a cleaning device that is blown through each tube to remove deposits from the interior of the tube. Direct access to tube ends is required for a PIG to be used.

Figure 9:
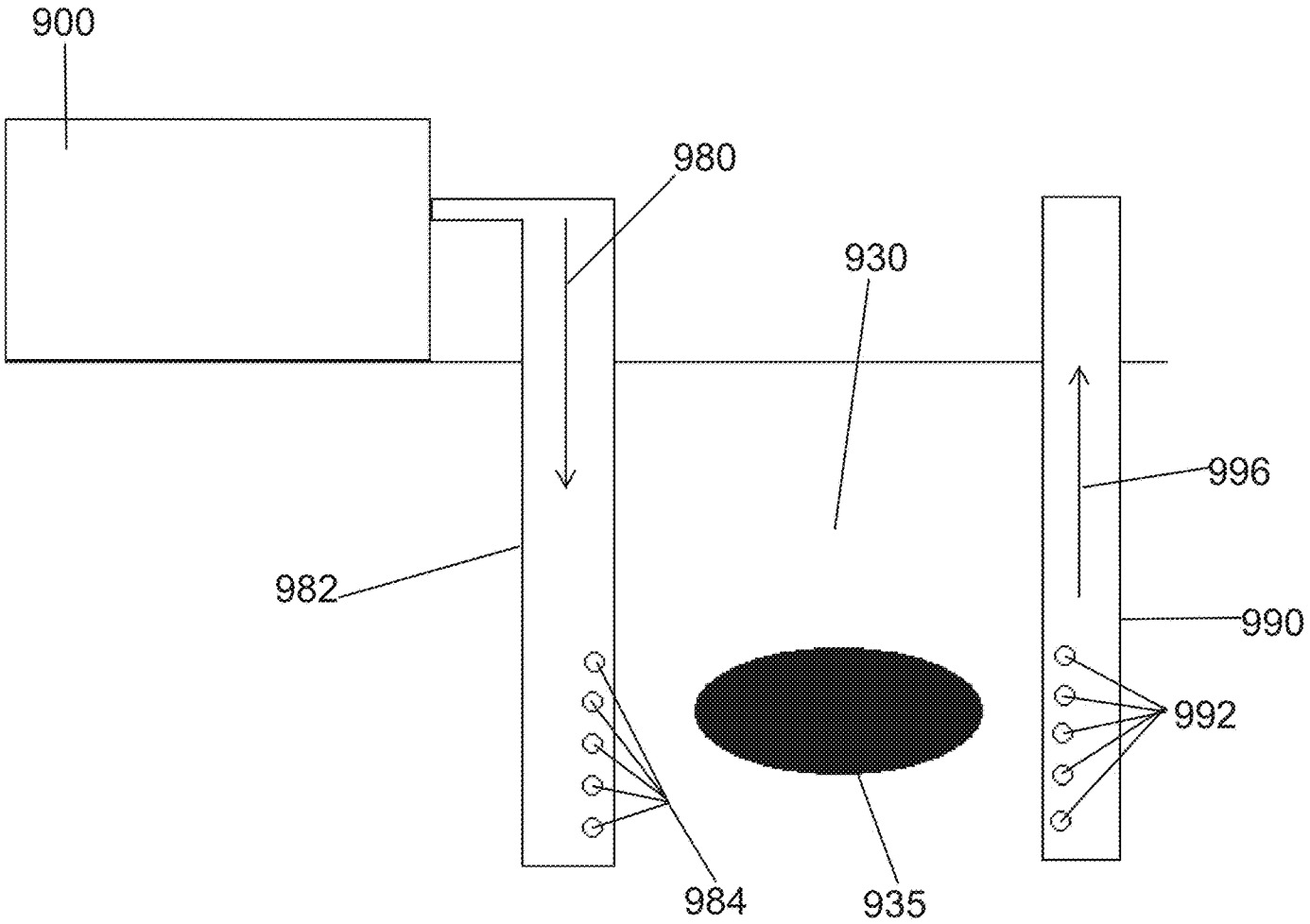
FIG. 9 is a schematic diagram illustrating the use of the supercritical steamflood boiler in enhancing recovery of hydrocarbons from an underground reservoir.

FIG. 9 illustrates how the supercritical steamflood boiler can be used to extract hydrocarbons from an underground reservoir 930. The supercritical steamflood boiler 900 provides supercritical steam 980 to an injection well 982. The supercritical steam is then injected into the reservoir through injection well outlets 984 of the injection well 982. The heat from the steam 980 reduces the viscosity of the hydrocarbons 935, liberating the hydrocarbons from the reservoir. The hydrocarbons (reference numeral 996) travel into production well inlets 992 of a production well 990, where they can now be extracted from the reservoir using conventional pumping technologies. While the injection well 982 and production well 990 are illustrated here as vertical wells, other configurations are also contemplated, including slanted wells, horizontal wells, and wells with horizontal or slanted legs. For example, the injection wells 982 may include horizontal legs which extend underneath the oil to be extracted while the production wells 990 include horizontal legs which extend above the oil to be extracted.

Figure 10:
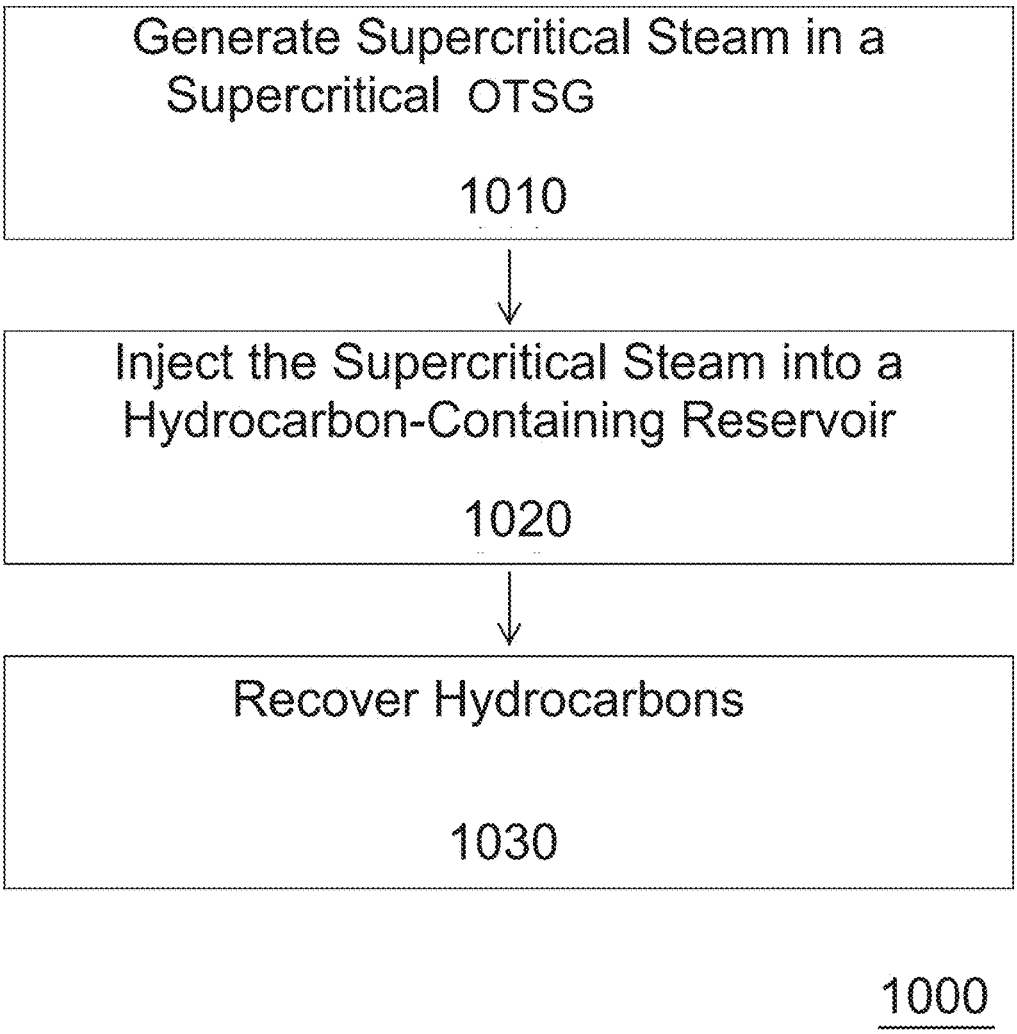
FIG. 10 is a flow chart explaining the use of the supercritical steamflood boiler in enhancing recovery of hydrocarbons from an underground reservoir.

FIG. 10 is a flow chart illustrating an exemplary method 1000 for enhancing the recovery of hydrocarbons from an underground, hydrocarbon-containing reservoir. Supercritical steam is generated in a supercritical OTSG 1010. The supercritical steam is then injected into the reservoir 1020. The hydrocarbons thus liberated are then recovered 1030.

Figure 11:
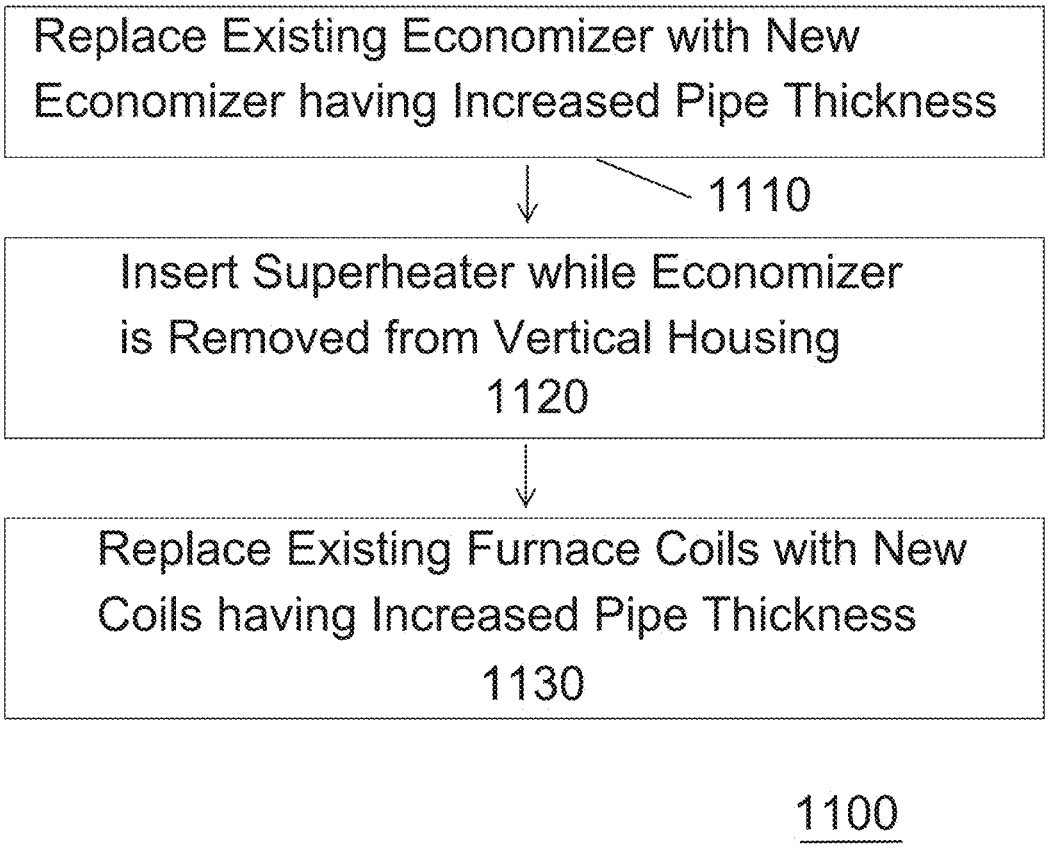
FIG. 11 is a flow chart explaining how a subcritical steamflood boiler can be retrofitted to arrive at a supercritical steamflood boiler should conversion of an existing boiler be desirable rather than the supply of a complete new boiler.

A subcritical steamflood boiler can be retrofitted into a supercritical OTSG by the replacement of certain components. FIG. 11 is a flow chart illustrating an exemplary method 1100 for retrofitting an existing subcritical steamflood boiler to obtain a supercritical OTSG. The existing economizer may be removed and replaced with an economizer having an increased pipe thickness 1110 to accommodate the higher fluid pressures. A superheater is not used with subcritical steamflood boilers, and so a superheater module (if required) is inserted into the vertical housing 1120 while the economizer is removed. The superheater may be inserted beneath the economizer. The furnace coils may also be replaced with thicker pipes due to the higher fluid pressures and temperatures 1130.

It is contemplated in additional embodiments that the supercritical OTSG can be made without a superheater and without a steam separator while still achieving temperatures above the critical point. In such embodiments, the tubing of the furnace coils and the economizer may need to be made with high alloy metals depending on process steam temperature requirements.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

We claim:

1. An apparatus for producing supercritical steam for injection into an underground hydrocarbon-containing reservoir, comprising:

a radiant section for generating steam above the critical point, comprising a horizontal housing having a burner end and an exhaust end opposite the burner end, a burner located at the burner end, at least one furnace coil running in a serpentine path between the burner end and the exhaust end circumferentially and evenly spaced along an internal circumference of the horizontal housing, and a convection flue at the exhaust end; and a convection section of the apparatus for generating supercritical superheated steam, comprising a vertical housing that is located above the convection flue and that contains a superheater in fluid communication with the at least one furnace coil and an economizer located in the convection section above the superheater;

wherein flue gas generated by the burner travels horizontally through the radiant section and travels vertically through the vertical housing;

wherein the economizer is tapered, with a greater surface area adjacent the superheater; and wherein the apparatus is devoid of a steam separator.

2. The apparatus of claim 1, further comprising a preheater upstream of the economizer.

3. The apparatus of claim 1, wherein the apparatus is configured to operate on a once-through basis.

4. The apparatus of claim 1, wherein the furnace coil and superheater include bores that are not ribbed.

5. The apparatus of claim 1, wherein the economizer comprises a plurality of tube rows having the same length.

6. A supercritical once-through steam generator, comprising:

a radiant section comprising a cylindrical horizontal housing having a burner end and an exhaust end opposite the burner end, a burner located at the burner end, at least one furnace coil running in a serpentine path between the burner end and the exhaust end circumferentially and evenly spaced along an internal circumference of the horizontal housing, and an outlet port at the exhaust end that leads to a convection flue, wherein a perimeter of the outlet port is formed by an arc and a chord; and a convection section comprising a vertical housing that is located above the convection flue;

wherein the once-through steam generator is devoid of a steam separator;

wherein the convection section includes a superheater in fluid communication with the at least one furnace coil and an economizer above the superheater, the economizer being in fluid communication with the at least one furnace coil;

wherein the economizer is tapered, with a greater surface area adjacent the superheater; and wherein flue gas generated by the burner travels horizontally through the radiant section and travels vertically through the vertical housing.

7. The once-through steam generator of claim 6, further comprising a feedwater preheater upstream of the economizer.

8. The once-through steam generator of claim 7, wherein the feedwater preheater is a dual pass heat exchanger comprising a first pass inlet for receiving feedwater, a first pass outlet in fluid communication with an inlet of the economizer, a second pass inlet in fluid communication with an outlet of the economizer, and a second pass outlet in fluid communication with the at least one furnace coil.

9. The once-through steam generator of claim 6, further comprising a feedwater purifier upstream of the economizer.

10. The once-through steam generator of claim 6, wherein fluid in the superheater flows in parallel with flue gas traveling through the once-through steam generator.

11. The once-through steam generator of claim 6, wherein the at least one furnace coil is smooth bored or is finned.

12. The once-through steam generator of claim 6, wherein the radiant section includes a total of two furnace coils.

13. The once-through steam generator of claim 12, wherein fluid flow from the two furnace coils are combined prior to being split at the superheater.

14. The once-through steam generator of claim 6, wherein fluid flow through the superheater is split into a first superheater coil and a second superheater coil.

15. The once-through steam generator of claim 6, wherein the furnace coil and superheater include bores that are not ribbed.

16. The once-through steam generator of claim 6, wherein the economizer comprises a plurality of tube rows having the same length.

17. A method of enhancing recovery from an underground hydrocarbon-containing reservoir, comprising:

generating supercritical steam in a supercritical once-through steam generator; and injecting the supercritical steam into the reservoir to recover hydrocarbons;

wherein the supercritical once-through steam generator comprises:

a radiant section comprising a horizontal housing having a burner end and an exhaust end opposite the burner end, a burner located at the burner end, at least one furnace coil running in a serpentine path between the burner end and the exhaust end circumferentially and evenly spaced along an internal circumference of the horizontal housing, and a convection flue at the exhaust end; and a convection section comprising a vertical housing that is located above the convection flue and that contains a superheater in fluid communication with the at least one furnace coil and an economizer above the superheater, the economizer being in fluid communication with the at least one furnace coil;

wherein the economizer is tapered, with a greater surface area adjacent the superheater;

wherein the once-through steam generator is devoid of a steam separator;

wherein flue gas generated by the burner travels horizontally through the radiant section and travels vertically through the vertical housing; and wherein the at least one furnace coil comprises:

an inlet through which water enters the at least one furnace coil at a temperature of from about 400° F. to about 450° F.; and an outlet through which water exits the at least one furnace coil at a temperature of from about 700° F. to about 750° F.

18. The method of claim 17, wherein the supercritical steam is injected into the reservoir through a plurality of injection well outlets.

19. The method of claim 17, wherein the hydrocarbons are recovered through one or more production wells.

20. The method of claim 17, wherein the furnace coil and superheater include bores that are not ribbed.

21. The method of claim 17, wherein the economizer comprises a plurality of tube rows having the same length.

* * * * *